US009247810B2

(12) United States Patent
Metzler

(10) Patent No.: US 9,247,810 B2
(45) Date of Patent: Feb. 2, 2016

(54) DEVICE FOR STORING UTENSILS, ESPECIALLY TOOLS

(71) Applicant: Metzler GmbH & Co KG, Rankweil (AT)

(72) Inventor: Reinhard Metzler, Rankweil (AT)

(73) Assignee: METZLER GMBH & CO KG, Rankweil (AT)

( * ) Notice: Subject to any disclaimer, the term of this patent is extended or adjusted under 35 U.S.C. 154(b) by 0 days.

(21) Appl. No.: 14/350,430

(22) PCT Filed: Oct. 4, 2012

(86) PCT No.: PCT/AT2012/000249

§ 371 (c)(1),
(2) Date: Apr. 8, 2014

(87) PCT Pub. No.: WO2013/052975

PCT Pub. Date: Apr. 18, 2013

(65) Prior Publication Data

US 2014/0265789 A1 Sep. 18, 2014

(30) Foreign Application Priority Data

Oct. 13, 2011 (AT) ..... 1487/2011

(51) Int. Cl.

| | |
|---|---|
| ***A47B 57/04*** | (2006.01) |
| ***A47B 88/04*** | (2006.01) |
| ***B25H 3/06*** | (2006.01) |

(52) U.S. Cl.

CPC ..... *A47B 57/04* (2013.01); *A47B 57/045* (2013.01); *A47B 88/04* (2013.01); *A47B 88/0422* (2013.01); *B25H 3/06* (2013.01)

(58) Field of Classification Search

CPC ..... A47B 57/04; A47B 88/06; A47B 57/045; A47B 57/00; A47B 96/024; A47B 96/025; A47B 96/027; A47B 96/028; A47B 96/061; A47B 96/067; A47B 88/04; A47B 88/0422; A47F 5/0846; A47F 5/08; A47F 5/12; A47F 5/018; A47F 5/0037; A47F 5/0081; A47F 5/16; A47F 2005/165; A47F 7/0021; A47F 7/0028; A47F 7/0035; B25H 3/06; B25H 3/04

USPC ..... 248/242; 211/150, 94.01, 95, 96, 99, 211/100, 90.04, 164, 126.5, 88.01, 126.1, 211/126.14, 133.3, 90.01, 90.02, 193, 70.6, 211/87.01; 312/245, 323, 298, 302, 303, 312/330.1, 334.1, 334.7; 108/108, 6, 138, 108/143

See application file for complete search history.

(56) References Cited

U.S. PATENT DOCUMENTS 2,963,170 A * 12/1960 Lori ..... A47B 57/04 108/106
3,093,094 A * 6/1963 Oztekin ..... 248/242

(Continued)

FOREIGN PATENT DOCUMENTS

CN 2098844 U 3/1992
CN 2188884 Y 2/1995

(Continued)

OTHER PUBLICATIONS

Hahn+Kolb Gruppe, Tool-System Kombi-Aktionen, Catalogue dated Dec. 31, 2011.

*Primary Examiner* — Daniel J Troy
*Assistant Examiner* — Hiwot Tefera
(74) *Attorney, Agent, or Firm* — Volpe and Koenig, P.C.

(57) ABSTRACT

A device for storing utensils, especially tools, comprises at least one storage tray unit (1) for accommodating utensils to be stored, which storage tray unit can be connected to a carrying unit (5) for carrying the storage tray unit (1) and can be removed from the carrying unit (5). The storage tray unit (1) comprises at least one lug (12, 13, 14) which can be inserted into a receiving groove (8) of the carrying unit (5) in order to connect the storage tray unit (1) to the carrying unit (5), the storage tray unit (1) connected to the carrying unit (5) projecting from the carrying unit (5). In order to connect the storage tray unit (1) to the carrying unit (5) in various angular positions, different lugs (12, 13, 14) of the storage tray unit (1) can be inserted into the receiving groove (8) of the carrying unit (5).

18 Claims, 10 Drawing Sheets

(56) References Cited

U.S. PATENT DOCUMENTS 3,426,993 A * 2/1969 Johansson ..... A47B 57/045 211/135
3,463,433 A * 8/1969 Coe et al. ..... 248/242
3,550,891 A * 12/1970 Scott ..... A47B 57/045 108/108
3,631,821 A * 1/1972 Zachariou ..... A47B 57/42 108/152
3,700,114 A * 10/1972 Myers ..... 211/150
3,795,379 A * 3/1974 Gray ..... 248/242
4,008,873 A * 2/1977 Travaglio et al. ..... 248/242
4,108,085 A * 8/1978 Shepherd et al. ..... 108/108
4,228,906 A * 10/1980 Jones ..... 211/88.01
4,307,671 A * 12/1981 Albano ..... 108/6
4,609,173 A * 9/1986 Belokin ..... 248/223.41
4,869,378 A * 9/1989 Miller ..... 211/94.01
5,042,672 A * 8/1991 Mehlin ..... A47B 57/04 211/170
5,117,986 A * 6/1992 Lin ..... 211/90.02
5,169,221 A * 12/1992 Wheeler ..... 312/323
5,244,272 A * 9/1993 Thompson ..... 312/334.23
5,259,519 A * 11/1993 Lieberman ..... 211/66
5,275,281 A 1/1994 Ebeling
5,452,875 A * 9/1995 Kern ..... A47B 96/067 108/108
5,484,068 A 1/1996 Huang
5,485,933 A * 1/1996 Crooymans ..... 211/90.04
5,941,026 A * 8/1999 Eisenreich et al. ..... 52/36.5
5,960,965 A * 10/1999 Saunders ..... A47F 5/0846 211/35
6,091,600 A * 7/2000 Jeong ..... G06F 1/1616 361/679.12
6,354,552 B1 * 3/2002 Chiu ..... 248/422
7,140,703 B1 * 11/2006 Holdgate, III ..... A47B 88/18 312/323
8,075,075 B2 * 12/2011 Haller et al. ..... 312/408
2001/0035114 A1 * 11/2001 Ash et al. ..... 108/147
2004/0195945 A1 10/2004 Farber et al.
2007/0012636 A1 1/2007 Wisnoski et al.
2007/0278168 A1 * 12/2007 Li ..... 211/94.01
2008/0041802 A1 * 2/2008 Kao ..... 211/70.6
2009/0019883 A1 * 1/2009 Haller et al. ..... 62/465
2009/0161309 A1 * 6/2009 Yang ..... 361/679.39
2010/0326930 A1 12/2010 Chiang
2012/0273633 A1 * 11/2012 Henriott et al. ..... 248/205.1

FOREIGN PATENT DOCUMENTS

CN 2371868 Y 4/2000
CN 2413791 Y 1/2001
CN 1578896 A 2/2005
CN 101065040 A 10/2007
DE 8518079.3 8/1985
DE 19646531 6/1998
DE 20314773 1/2004
DE 60307171 7/2007
GB 2297896 8/1996
GB 2423790 9/2006
WO 2006047783 5/2006
WO 2006057564 A1 6/2006
WO 2008095121 8/2008
WO 2010054683 A1 5/2010

* cited by examiner

DEVICE FOR STORING UTENSILS, ESPECIALLY TOOLS

BACKGROUND

The invention relates to a device for storing utensils, in particular tools, said device including at least one storage tray unit for accommodating utensils to be stored which is connectable to a carrying unit for carrying the storage tray unit and is removable from the carrying unit, wherein the storage tray unit comprises at least one lug which is insertable into an accommodating groove of the carrying unit for connecting the storage tray unit to the carrying unit, and wherein the storage tray unit connected to the carrying unit extends out from the carrying unit and at least one storage tray unit is connectable to the carrying unit in at least two different angular positions with reference to a horizontal axis.

Tool cabinets, the drawers of which are provided with compartments, are known. To use a tool, the corresponding drawer has to be pulled open and the tool taken out and subsequently put away again into the corresponding compartment. If the tools are to be used at a remote site, the required tools have to be removed out of the tool cabinet and subsequently put away again in the compartments provided. Maintaining a predefined system of order is consequently laborious.

Placing rigid foam liners, in which recesses are provided which are adapted precisely to the tools to be accommodated and form compartments adapted to the respective tools, with the tools inserted therein in drawers of tool cabinets is also known such that the rigid foam liners with the tools accommodated therein can be removed, when required, and moved to the site of use. Such handling, however, is also relatively awkward and involved. In addition, metal trays with plastics material inserts which comprise compartments for accommodating tools are also known.

The device emanating from DE 603 07 171 T2 provides tray-shaped carrying units which are mounted at different heights on a vertical stand and are pivotable about the vertical axis of the stand. Tray storage units which comprise compartments for accommodating utensils to be stored, in particular tools, can be inserted into the indentations of the respective carrying unit, and removed out of said indentations.

A device where tool containers, which can be seen as tray storage units, can be suspended on an upwardly extend web by hook-like elements, which can be seen as lugs, proceeds from US 2007/0012636 A1. This web forms the lower boundary of an accommodating groove. In the case of the device known from DE 203 14 773 U1, hook-shaped elements of storage tray units are suspended on the upper edge of a rail-shaped carrying unit. In the case of both devices, additionally there are projecting elements which protrude into a groove of the carrying unit, by which unintentional raising of the storage tray unit is to be restricted.

US 2010/0326930 A1 shows a device of the type mentioned in the introduction where the carrying unit comprises two portions which are at an angle with respect to one another. Hook-shaped elements of a container can be suspended selectively on one of the two portions, the container being connectable to the carrying unit in two different angular positions.

SUMMARY

It is the object of the invention to provide a device of the type mentioned in the introduction which, with simple realization, enables advantageous handling of the at least one storage tray unit and where the accessibility or the presentation of the contents of the storage tray unit can be optimized for different situations. This is achieved by a device with one or more of the features of the invention.

In the case of the device according to the invention, a respective storage tray unit comprises at least one lug which is insertable into an accommodating groove of the carrying unit for connecting the storage tray unit to the carrying unit or to one of the carrying units. In this connection, the storage tray unit connected to the carrying unit extends out from the carrying unit. The side of the storage tray unit which lies opposite the side of the storage tray unit which comprises the at least one lug (that is the side of the storage tray unit remote from the carrying unit), is consequently free when the storage tray unit is connected to the carrying unit.

In an advantageous manner, the at least one lug of the storage tray unit inserted into the accommodating groove supports the storage tray unit against tilting up were the free side of the storage tray unit to move downward. To this end, the lug is supported by way of an abutment region against the upper boundary wall of the accommodating groove. In addition, the lug rests by way of a contact region which lies further outside (i.e. lying less deeply in the groove) on the lower boundary wall of the accommodating groove or a support region of the storage tray unit which lies outside the accommodating groove is supported in the region below the accommodating groove at the end face of the carrying unit.

The storage tray unit is therefore connectable to the carrying unit or removable from said carrying unit without any tools.

In an advantageous embodiment of the invention, the connection between the storage tray unit and the carrying unit is formed only by the at least one lug inserted into the accommodating groove, where applicable together with the abutment region of the storage tray unit which is supported at the end face of the carrying unit.

When connecting the storage tray unit to the carrying unit, the at least one lug of the storage tray unit is inserted in an insertion direction into the accommodating groove and when removing the storage tray unit from the carrying unit the at least one lug is pulled out of the accommodating groove in an opposite pull-out direction. With reference to said pull-out direction, the storage tray unit extends out from the carrying unit when connected to the carrying unit.

According to the invention, at least one of the storage tray units is connectable to the carrying unit in at least two different angular positions with reference to a horizontal axis. The storage tray unit comprises different lugs which are arranged in different angular positions with reference to the horizontal axis and are insertable selectively into the accommodating groove of the carrying unit for connecting the storage tray unit to the carrying unit in different angular positions. With the storage tray unit connected to the carrying unit in the different angular positions, the side of the storage tray unit which lies opposite the side comprising the at least one lug, is arranged at different heights. The accessibility or the presentation of the contents of the storage tray unit can consequently be optimized in each case for different situations.

In the state connected to the carrying unit, the storage tray unit is preferably secured in a positive locking manner against the at least one lug of the storage tray unit being pulled out of the accommodating groove of the carrying unit. For this purpose an advantageous design provides that a respective lug of the storage tray unit comprises a projection which stands out upward from the lug in the state inserted into the accommodating groove and engages in an indentation in the upper boundary wall of the accommodating groove. When connected to the carrying unit, the storage tray unit, as a result, is secured in a positive locking manner against a respective lug being pulled in a rectilinear manner out of the accommodating groove of the carrying unit. For connecting and removing, the storage tray unit is tilted about a horizontal axis, which lies parallel to the longitudinal extension of the accommodating groove of the carrying unit, with respect to the position which it assumes when connected to the carrying unit, the side of the storage tray unit which lies opposite the side comprising the at least one lug lying higher than in the position of the storage tray unit in which said storage tray unit is connected to the carrying unit. For connecting the storage tray unit to the carrying unit, the at least one lug, in this tilted position of the storage tray unit, is inserted into the accommodating groove of the carrying unit and then the side of the storage tray unit which lies opposite the side which comprises the at least one lug is lowered until the storage tray unit is carried by the carrying unit, the projection of the respective lug engaging in the indentation in the upper boundary wall of the accommodating groove. To remove the storage tray unit from the carrying unit, the reverse sequence is carried out.

Other types of positive locking connections are conceivable and possible. Thus, for example, the carrying unit could comprise at least one element which latches (snaps) in a resiliently elastic manner in behind a projection of the at least one lug, to remove the storage tray unit from the carrying unit the positive locking means could be overcome in particular by overcoming the spring force of the resiliently elastic element.

In an advantageous embodiment of the invention, at least part of the lugs comprise a snap-type projection which, with the lug inserted into the accommodating groove, stands out downward and which, when the lug is inserted into the accommodating groove, snaps into a snap-in indentation in the lower boundary wall of the accommodating groove. All the lugs are preferably provided with at least one such snap-type projection which, when inserted, is snapped into a snap-in indentation in the lower boundary wall of the accommodating groove. Such a snap-type projection can be arranged, for example, on an end cap which consists in particular of plastics material and which closes a profiled rail portion at the end face. In an expedient manner, the profiled rail portion is closed at both ends of such end caps. The profiled rail together with the at least one end cap forms a connecting piece which comprises lugs aligned in different angular positions for insertion into the accommodating groove.

In an advantageous manner, the at least one snap-type projection of a respective lug is present in addition to the projection which, when inserted into the accommodating groove of the lug, engages in the indentation in the upper boundary wall of the accommodating groove.

The carrying unit or a respective carrying unit is formed in an expedient manner by a profiled rail or includes such a profiled rail, said profiled rail having a groove which is continuous in the longitudinal direction for insertion of the at least one lug of the storage tray unit. Said profiled rail is formed in an expedient manner by an extruded profile.

The carrying unit or a respective carrying unit can be fastenable or fastened for example directly or by at least one further fastening part on a wall, for example on a building wall or on a wall of a machine or on a carrying wall (which is fastened on a building wall or on a machine or on a supporting structure). For example, the fastening can be effected by means of, in particular vertical, fastening rails which are mounted on the wall. Fastening on a supporting structure which can also be formed by a machine frame is also possible. Apart from a stationary design, fastening the carrying unit or at least one of the carrying units or all of the carrying units on a movable part can also be provided.

In an expedient manner, the device includes several carrying units which are arranged or can be arranged one above another at different heights and several storage tray units which are selectively connectable to the carrying units.

In an advantageous embodiment of a storage tray unit, said storage tray unit comprises a tray body on which on one of its side edges are fixed first and second connecting pieces which are spaced apart from one another in the direction of the extension of said side edge and are preferably fastened on the tray body in the two edge regions of said side edge of the tray body. The connecting pieces comprise in each case at least one lug for insertion into the accommodating groove, preferably in each case several lugs aligned in different angular positions. When connecting the storage tray unit to the carrying unit, one of the lugs from each of the connecting pieces is inserted into the accommodating groove of the carrying unit.

A respective connecting piece preferably comprises a portion of an extruded profile or is formed by such an extruded profile.

In an advantageous embodiment of the invention, it is provided that the carrying unit connected to the storage tray unit is displaceable in the longitudinal direction of the carrying unit, the at least one lug inserted into the accommodating groove being displaced along the accommodating groove.

A device according to the invention can be used for depositing or storing utensils, in particular tools, it being possible in a very simple manner to take the utensils to a remote site of use, remaining in this connection in the storage tray unit. A device according to the invention can also be used, for example, in an advantageous manner in a sales or exhibition room for the presentation of goods. To examine the goods in more detail, in this connection, the storage tray unit, when desired, together with the goods, can be removed in a simple manner from the carrying unit.

By using a storage tray unit according to the invention, a pull-out guide means can also be realized. In a first embodiment, to this end, the storage tray unit is provided with at least two casters which are rotatably mounted on opposite sides of the storage tray unit. The storage tray unit is insertable with the casters into first and second guide rails and is then displaceable with respect to said guide rails in the longitudinal direction of the guide rails. The first and second guide rails, in this connection, preferably comprise in each case at least one rotatably mounted caster, on which in each case a guide web of the storage tray unit rests.

The storage tray unit can consequently be utilized as a drawer when it is inserted into the guide rails. When it is removed from the guide rails, the storage tray unit can consequently be connected to a carrying unit in the manner already described.

According to a second embodiment for realizing a pull-out guide means, there is provided a guide unit which comprises an accommodating groove into which the storage tray unit or one of the storage tray units is insertable by way of at least one of its lugs for connecting the storage tray unit to the guide unit. Analogously to the connection between the storage tray unit and the carrying unit, the storage tray unit connected to the guide unit extends out from the guide unit, i.e. the side of the storage tray unit which is remote from the guide unit is free. The guide unit is mounted so as to be displaceable with respect to first and second guide rails in the longitudinal direction of the guide rails. In an advantageous manner, the first and second guide rails comprise casters which are rotatably mounted on opposite sides on the guide rails and which in each case roll between upper and lower running webs of the first and second guide rails. In this connection it is preferred that the guide unit is rotatably mounted in each case by at least two casters which are rotatably mounted on the guide unit in both the first guide rail and in the second guide rail. The guide unit consequently forms a type of running carriage which is displaceably guided in the guide rails by the casters.

The storage tray unit connected to the guide unit can consequently be utilized as a drawer. When the storage tray unit is removed from the guide unit, the storage tray unit can be connected to a carrying unit in the manner already described.

BRIEF DESCRIPTION OF THE SEVERAL VIEWS OF THE DRAWINGS

Further advantages and details of the invention are explained below by way of the accompanying drawing, in which.

DETAILED DESCRIPTION OF THE PREFERRED EMBODIMENTS

Figure 1:
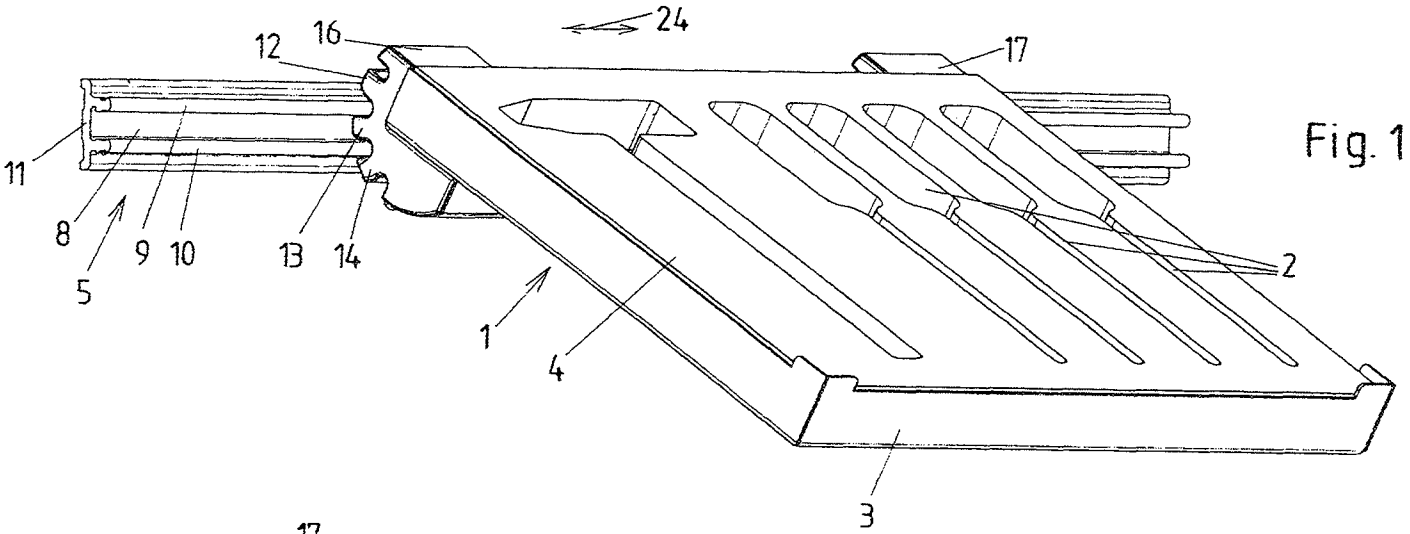
FIG. 1 shows an inclined view of an exemplary embodiment of a storage tray unit and of a carrying unit, in the connected state.
Figure 2:
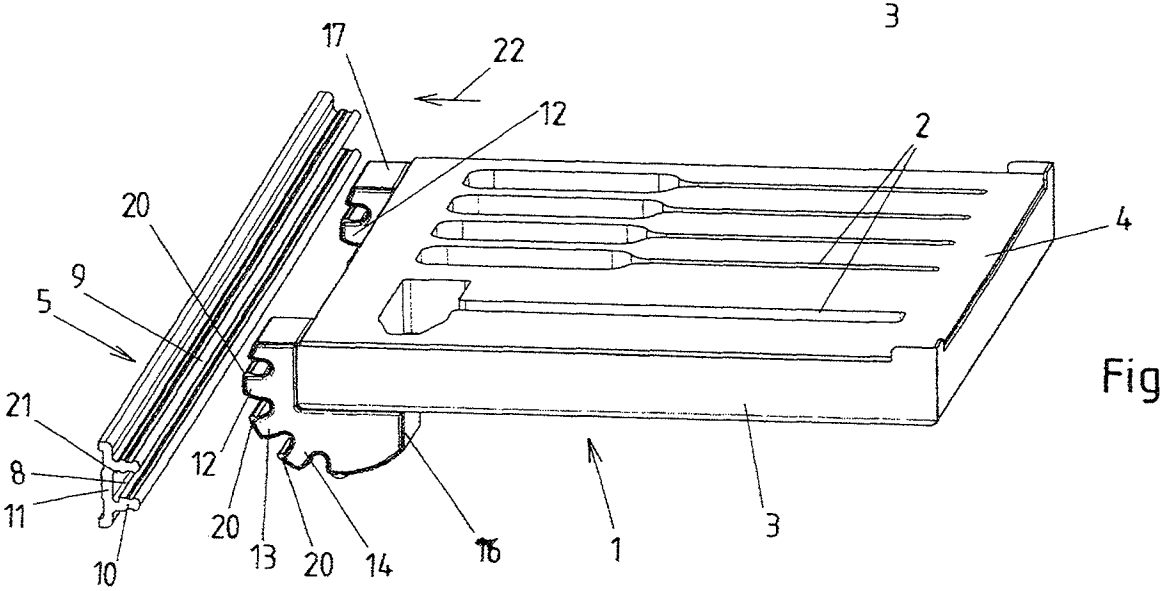
FIG. 2 and FIG. 3 show an inclined view from a different viewing direction and a side view of the parts of FIG. 1 in the state separated from one another.
Figure 3:
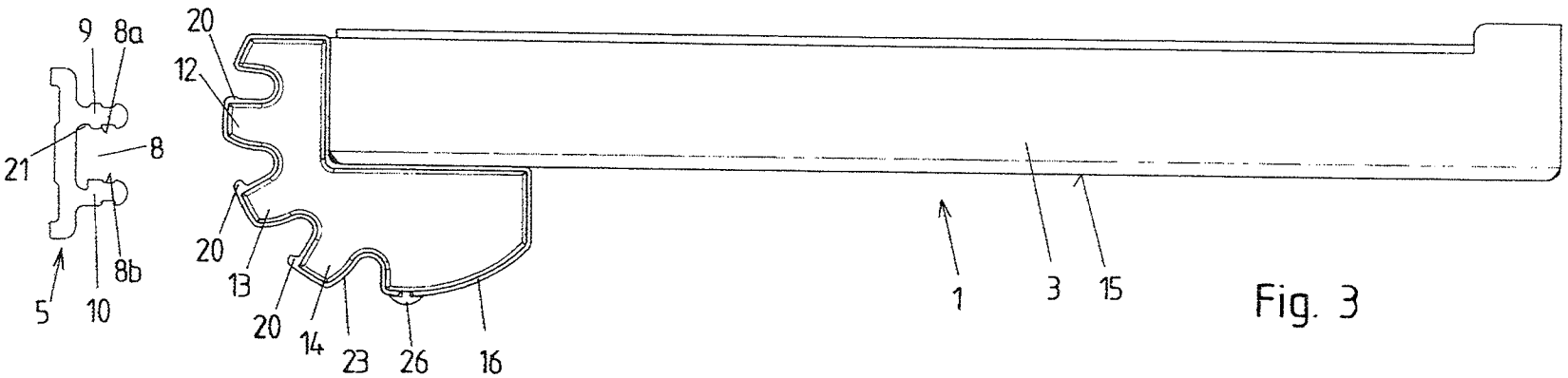

A first exemplary embodiment for a device according to the invention is shown in FIGS. 1 to 12.

The device according to the invention includes at least one storage tray unit 1 which is realized for accommodating utensils to be stored, for example tools. The storage tray unit 1 preferably has compartments 2 for this purpose, into which the utensils to be stored can be placed or inserted. In this connection, this can be, as shown as an example, compartments 2 which are adapted in each case to the utensils to be accommodated. It is also possible to provide compartments 2 which have not been specially adapted, for example rectangular and/or square compartments. Instead of this, the storage tray unit 1 could also have just one indentation, that is one single compartment, to accommodate all the utensils to be stored by the storage tray unit 1.

In the exemplary embodiment shown, the storage tray unit 1 includes a tray body 3 which comprises a bottom wall and side walls and into which a rigid foam liner 4 is inserted which comprises the compartments 2. Instead of this, other liners or inserts which realize the compartments, for example produced of a plastics material, could also be provided or the at least one compartment 2 could be formed directly by the tray body 3 without a further liner or a further insert being present.

A carrying unit 5, to which the storage tray unit 1 is connectable in a tool-free manner and from which the storage tray unit 1 is removable in a tool-free manner, serves for carrying the storage tray unit 1. A device according to the invention can include one or several carrying units. A respective carrying unit 5 is fastened directly or by at least one further part which lies in between on a stationary part (for example a wall of a building, an item of furniture or a machine or on a supporting structure) or on a movable carriage, a movable item of furniture or a movable machine. The fastening is effected, for example, by screws (cf. FIGS. 4 to 6) which penetrate openings 6 (cf. FIGS. 7 and 9). A device according to the invention can also comprise a unit with several carrying units which are connected together in a rigid manner, the unit being fastenable on a stationary or movable part.

The carrying unit 5 is realized in the exemplary embodiment shown as a profiled rail, in particular in the form of an aluminum extruded section. Other realizations are possible.

The carrying unit 5 comprises an accommodating groove 8 which extends continuously in the longitudinal direction of the profiled rail in the exemplary embodiment shown. The accommodating groove 8 runs horizontally in the mounted state of the carrying unit 5.

The accommodating groove 8 is defined by upper and lower boundary walls 8*a*, 8*b* (with reference to the mounting state). These boundary walls are formed in this case by an upper and a lower boundary web 9, 10 which stand out from a vertical base web 11. Other realizations of the accommodating groove 8 are conceivable and possible.

The storage tray unit 1, on an insertion side, has lugs 12, 13, 14 for connecting the storage tray unit 1 to the carrying unit 5 in various angular positions of the storage tray unit 1. In the various angular positions of the storage tray unit 1, a bottom 15 of the storage tray unit 1 lies in planes which are inclined variously with respect to the horizontal, one of said planes preferably being horizontal (that is comprises an inclination of 0° with respect to the horizontal). In the exemplary embodiment shown, the possible angles of inclination are 0°, 30° and 60°, the side of the storage tray unit which is opposite the insertion side lying lower than the insertion side in the case of the angles of inclination of 30° and 60°. Other and/or additional angles of inclination could also be provided, in particular within the range of between 0° and 90°. Angles of inclination where the side which is opposite the insertion side lies higher than the insertion side, for example within the range of between 0° and 45° could also be provided.

At least one lug 12, 13, 14 of the storage tray unit 1 is provided for each angle of inclination at which the storage tray unit can be connected to the carrying unit 5. In the exemplary embodiment shown, two lugs 12, 13, 14 are provided for each angle of inclination.

Figure 10:
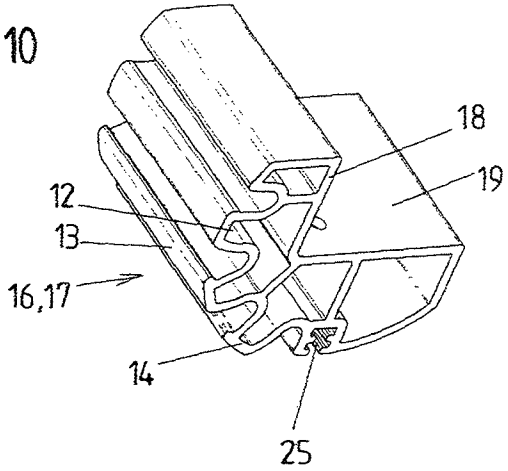
FIG. 10 shows an inclined view of a connecting piece for mounting on a tray body of the storage tray unit.
Figure 12:
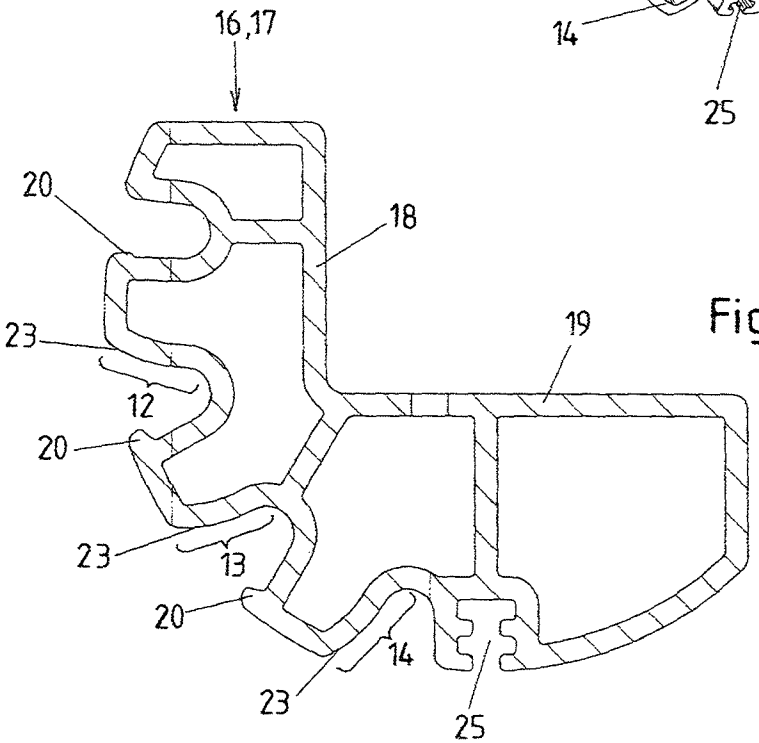
FIG. 12 shows a section along the line B-B of FIG. 11.
Figure 11:
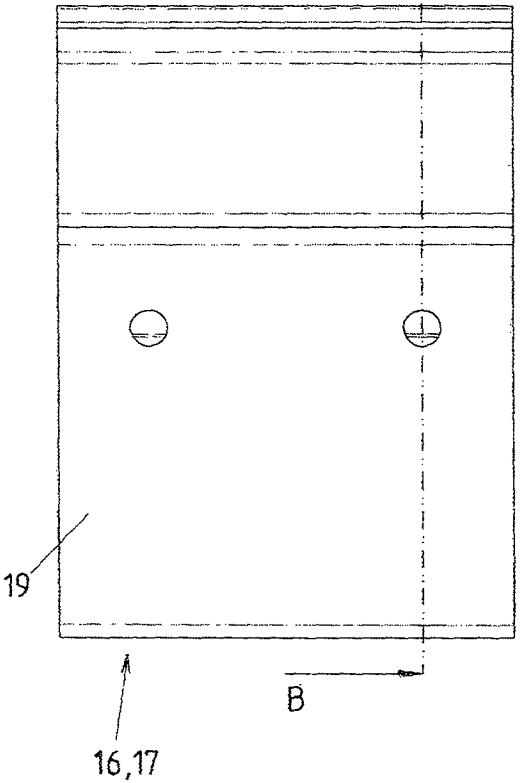
FIG. 11 shows a top view of the connecting piece.
Figure 13:
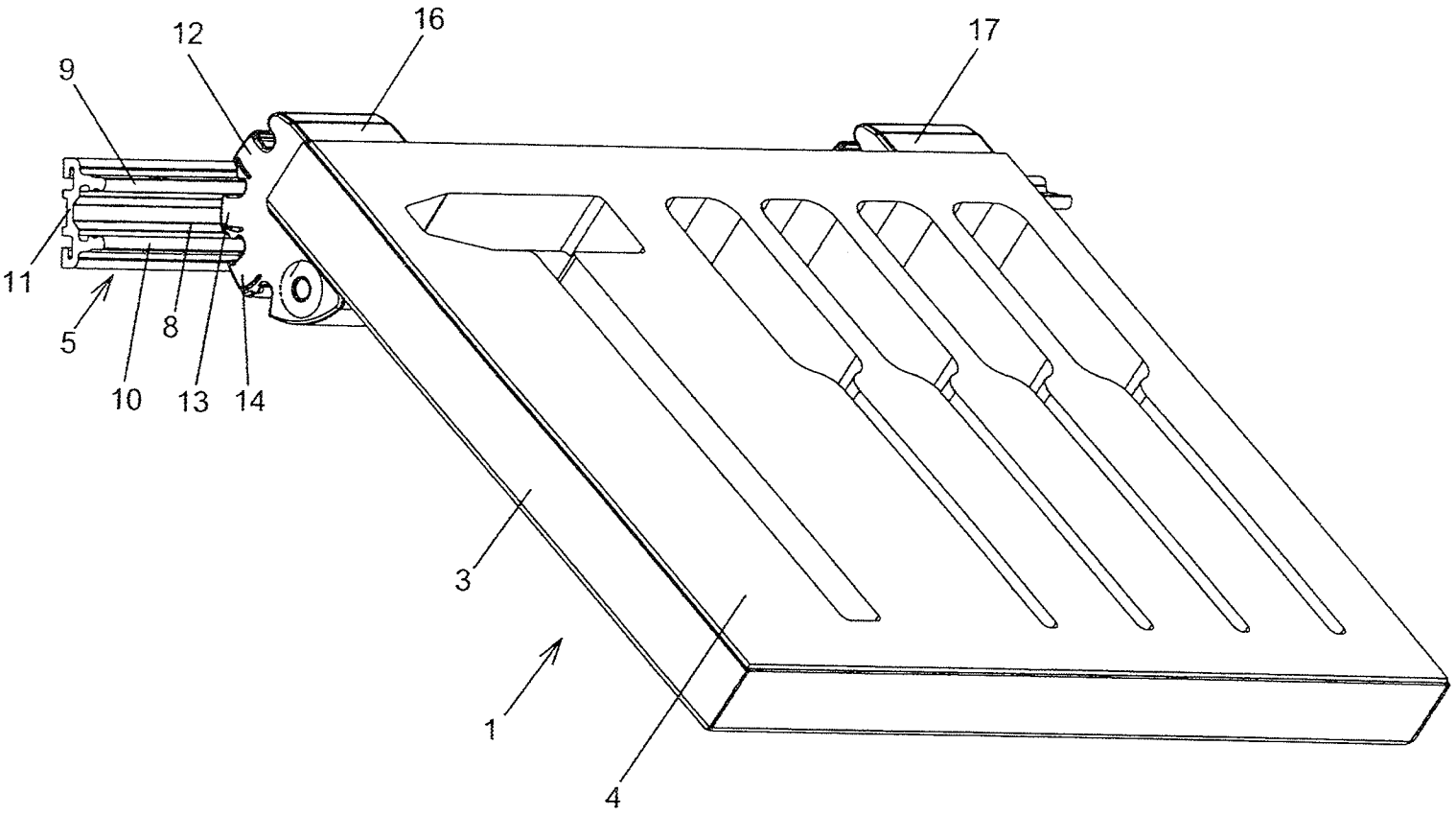
FIG. 13 shows a modified exemplary embodiment of a storage tray unit and of a carrying unit, in the connected state.

In an advantageous manner, the lugs 12, 13, 14 are realized on first and second connecting pieces 16, 17 which are fastened on the tray body 3, for example by a screw connection (screw holes are shown in FIGS. 10 to 12). As shown, abutment webs 18, 19 of the respective connecting piece 16, 17 which abut against the insertion-side side wall and against a portion of the bottom wall of the tray body 3 connecting thereto can be provided.

The connecting pieces 16, 17 can be formed in an expedient manner by portions of profiled rails, preferably aluminum extruded sections, which are realized in particular in the form of hollow sections. These profiled rails can be provided on both sides with covers in order to cover the inner cavity.

A respective connecting piece 16, 17 comprises, lugs 12, 13, 14 which extend in various directions which are at angles with respect to one another, corresponding to the desired angular positions with the storage tray unit connected to the carrying unit 5.

In place of two separate connecting pieces 16, 17 which are spaced apart from one another, one single connecting piece which comprises the lugs 12, 13, 14 could also be provided. It would also be conceivable and possible to provide a tray body 3 on which lugs 12, 13, 14 are directly integrally molded (at least one per angular position).

With the storage tray unit 1 connected to the carrying unit 5 in one of the possible angular positions, in each case at least one of the lugs 12, 13, 14 is inserted into the accommodating groove 8, in the exemplary embodiment shown two lugs 12, 13, 14 are inserted into the accommodating groove 8 in each angular position.

In the region of its free end, a respective lug 12, 13, 14 has a projection 20 which, with the lug 12, 13, 14 inserted into the accommodating groove 8, stands out upward and, with the storage tray unit 1 connected to the carrying unit 5, projects into an indentation 21 in the upper boundary wall 8*a* of the accommodating groove 8.

To connect the storage tray unit 1 to the carrying unit 5, the at least one lug 12, 13, 14 associated with the selected angular position of the storage tray unit 1 (in the exemplary embodiment two lugs) is inserted into the accommodating groove 8, from the open side of the accommodating groove 8 which lies opposite the groove bottom. The inserting of the respective at least one lug 12, 13, 14 is effected in an insertion direction 22 which points therefore in the direction of the depth of extension of the accommodating groove 8 (and not, for instance, in the direction of the longitudinal extension of the accommodating groove 8). When removing the storage tray unit 1 from the carrying unit 5, the at least one lug 12, 13, 14 which engages in the accommodating groove 8 is pulled out in the pull-out direction which is in the opposite direction to the insertion direction 22.

Figure 4A:
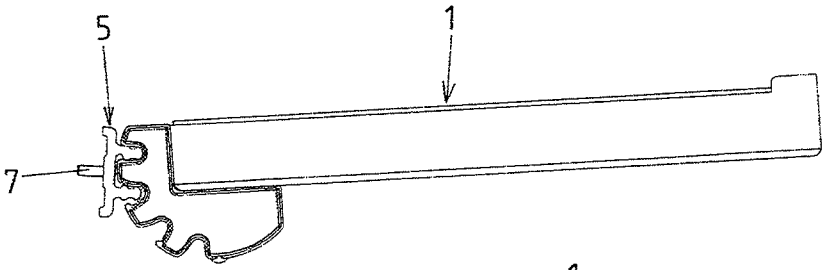
FIG. 4A shows a side view of an intermediate position when connecting the storage tray unit to the carrying unit.
Figure 6A:
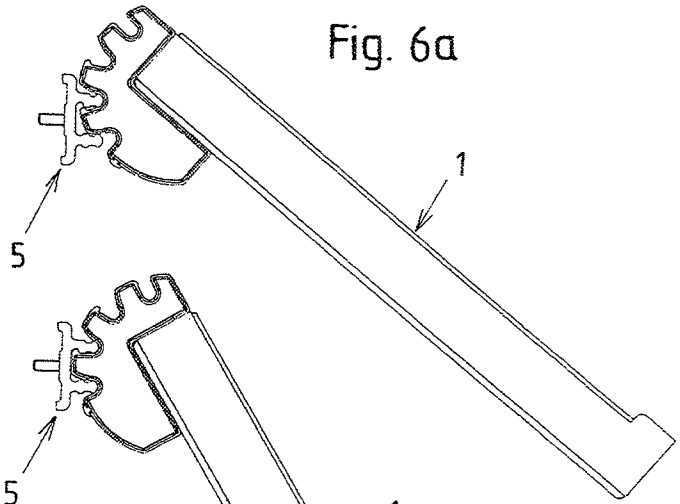
FIG. 6A and FIG. 6B show representations corresponding to FIGS. 4A and 4A in a further angular position of the storage tray unit.
Figure 5A:
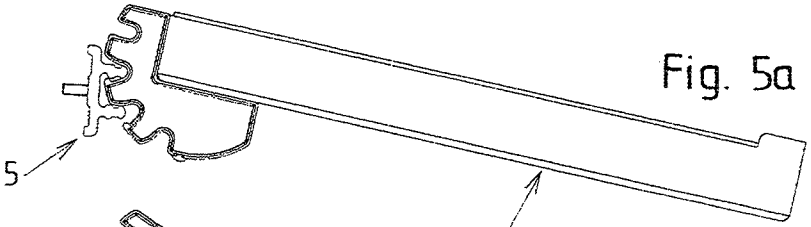
FIGS. 5A and 5B show representations corresponding to FIGS. 4A and 4B, but for producing the connection or in the connected state in an angular position of the storage tray unit which is other than in FIGS. 4A and 4B.

To insert the at least one lug 12, 13, 14 into the accommodating groove 8, the storage tray unit 1, with respect to the position which it assumes when connected to the carrying unit 5, is tilted about a horizontal axis which lies parallel to the longitudinal extension of the accommodating groove 8 and in this position is inserted in the insertion direction 22 in a rectilinear manner into the accommodating groove 8 with the at least one lug 12, 13, 14. This position assumed during insertion is shown in FIGS. 4A, 5A and 6A for the insertion of the various lugs 12, 13 and 14. In order to enable insertion of the at least one associated lug 12, 13, 14 in said position of the storage tray unit 1, the under-side of the respective lug 12, 13, 14 has a rounding 23, by means of which the cross section of the lug 12, 13, 14 tapers in the direction toward the free end of the lug 12, 13, 14. A bevel could also be provided in place of the rounding 23. The cross sectional tapering formed by the rounding 23 or bevel extends in an advantageous manner over at least a third of the entire extension of the lug 12, 13, 14 with reference to the insertion direction 22.

Once the respective at least one lug has been inserted, the storage tray unit is lowered with its side opposite the insertion side, i.e. is tilted about a horizontal axis, which lies in the region of the accommodating groove 8 and extends parallel to the accommodating groove 8, until the storage tray unit 1 is held in a positive locking manner by the carrying unit 5 against further tilting. In this connection, the projection 20 projects into the indentation 21 such that the storage tray unit 1 is secured in a positive locking manner by the carrying unit 5 against being pulled in a rectilinear manner out of the accommodating groove 8 in the pull-out direction, which is in the opposite direction to the insertion direction.

Figure 4B:
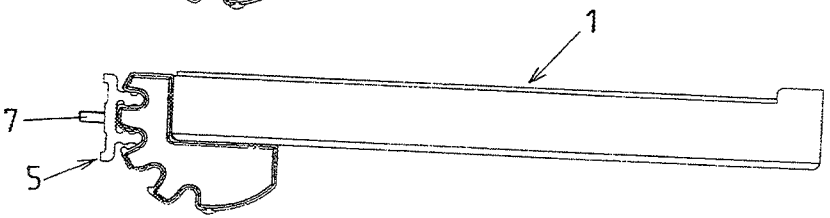
FIG. 4B shows a side view of the connected state.
Figure 6B:
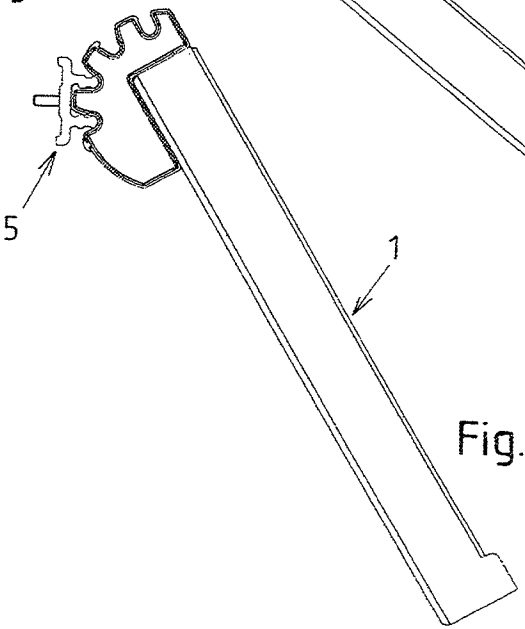
Figure 5B:
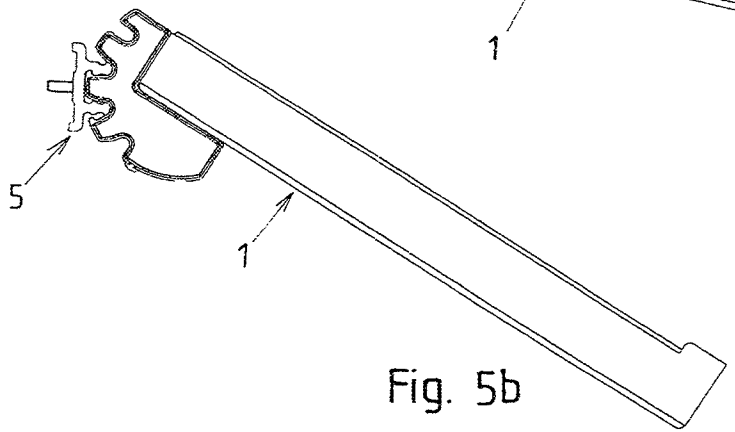
Figure 7:
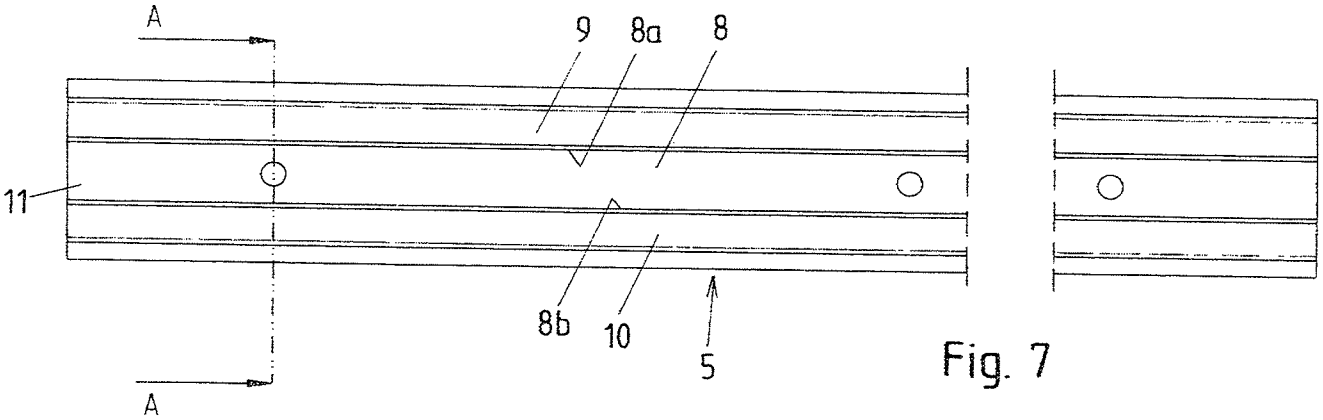
FIGS. 7 and 8 show a front view and a rear end view of the storage unit.
Figure 8:
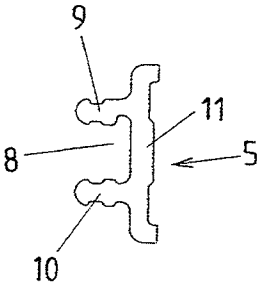
Figure 9:
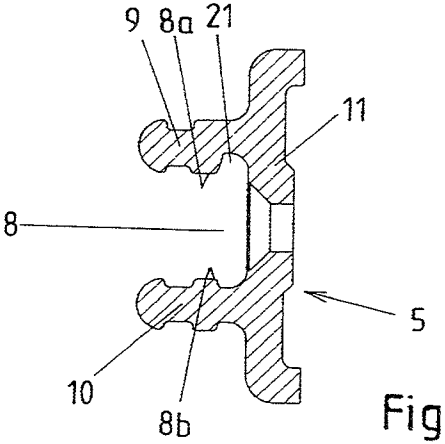
FIG. 9 shows a section along the line A-A of FIG. 7.

The state where the storage tray unit 1 is connected to the carrying unit 5 is shown for the various angular positions in FIGS. 4B, 5B and 6B.

The movement sequence described beforehand is carried out in a reverse manner to remove the storage tray unit 1 from the carrying unit 5.

The storage tray unit 1 which is connected to the carrying unit 5 and is carried by the carrying unit 5 stands out from the carrying unit in a freely protruding manner.

With the storage tray unit 1 connected to the carrying unit 5, the at least one lug 12, 13, 14 which is inserted into the accommodating groove 8 is supported by way of an abutment region against the upper boundary wall 8*a* of the accommodating groove 8. This abutment region can be formed by the projection 20 or by a region of the lug 12, 13, 14 adjacent the projection 10. In addition, the lug rests on the lower boundary wall 8*b* by way of a contact region which is placed further away from the groove bottom. Instead of this, a support region of the storage tray unit 1, which lies outside the accommodating groove 8 and lies below the at least one lug 12, 13, 14 which protrudes into the accommodating groove 8, could also be supported at the end face of the carrying unit 5, for example on the free end of the lower boundary web 10.

If the carrying unit 5 which is realized in a rail-shaped manner extends on both sides beyond the storage tray unit 1, as is shown in FIG. 1, the storage tray unit 1 inserted into the carrying unit 5 can be displaced in the longitudinal direction of the carrying unit 5, as is indicated in FIG. 1 by the double arrow 24. In order to facilitate the displaceability, the side of the storage tray unit 1 opposite the insertion side can be raised somewhat for this purpose.

The exemplary embodiment shown only shows one single storage tray unit 1 and one single carrying unit 5. In many cases of application a device according to the invention will include several carrying units 5 which are preferably arranged one above another in the mounted position and several storage tray units 1. In an expedient manner in this connection, the storage tray units 1 are realized identically at least in the respective connecting region and the carrying units 5 are realized identically at least in the respective connecting region. Which of the storage tray units 1 is connected to which of the carrying units 5 can therefore be freely chosen.

The connecting pieces 16, 17 comprise a groove 25 for the insertion of a rubber strip 26 such that the storage tray unit 1 can be put down gently on a support in the region of the connecting pieces 16, 17. In the region of the opposite side of the storage tray unit 1, rubber elements can also be provided on the underside so that it can be put down on a support.

A modified exemplary embodiment of the invention is shown in FIGS. 13 to 19. Apart from the differences described below, the design corresponds to the exemplary embodiment described by way of FIGS. 1 to 12.

Figure 19:
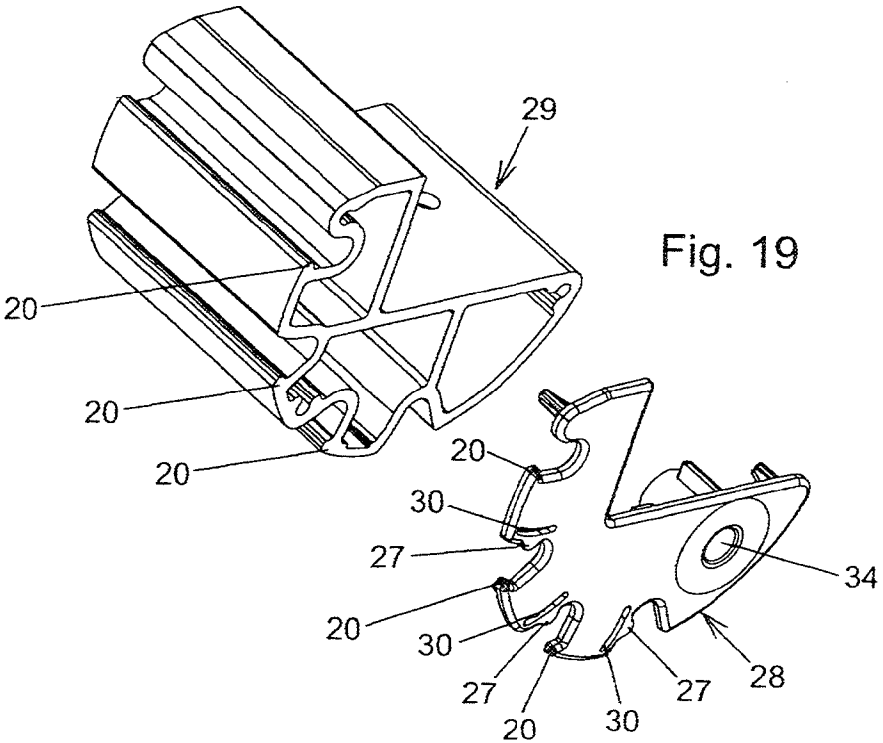
FIG. 19 shows an inclined view of a profiled rail portion and of an end cap for realizing a connecting piece according to the modified embodiment of the invention.

In the case of this modified exemplary embodiment, the lugs 12, 13, 14 are provided with downwardly projecting snap-type projections 27 in addition to the projections 20 which stand out upward in each case in the state inserted into the accommodating groove 8. In the exemplary embodiment shown, the snap-type projections 27 are formed by end caps 28 which close the profiled rail portion 29 of the respective connecting piece 16, 17 at the end face. Just one such end cap 28 is shown in FIG. 19. In a preferred manner, however, both ends of the profiled rail portion 29 are closed by an end cap, the end cap, which is not shown, being realized in a mirror-symmetrical manner to the end cap 28. The end caps together with the profiled rail portion 29 form the respective connecting piece 16, 17.

The end caps 28 are formed preferably of plastics material. In order to make it possible for the snap-type projections 27 to be pressed in elastically, the end caps 28 are preferably provided with openings 30 in the regions adjacent the snap-type projections 27.

Figure 15:
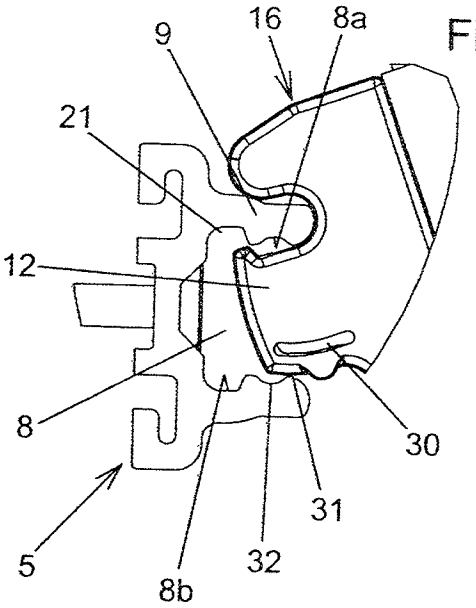
FIG. 15 shows an enlarged detail A of FIG. 14.
Figure 17:
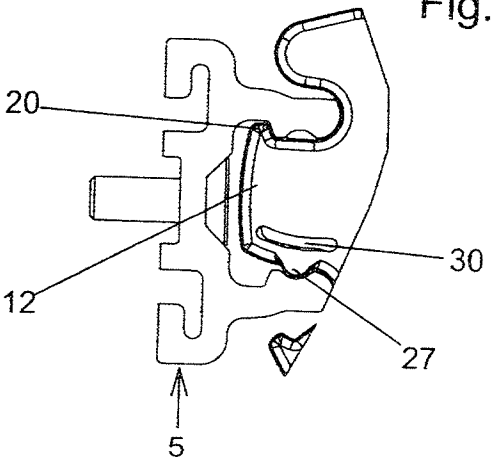
FIG. 17 shows an enlarged detail B of FIG. 16.
Figure 14:
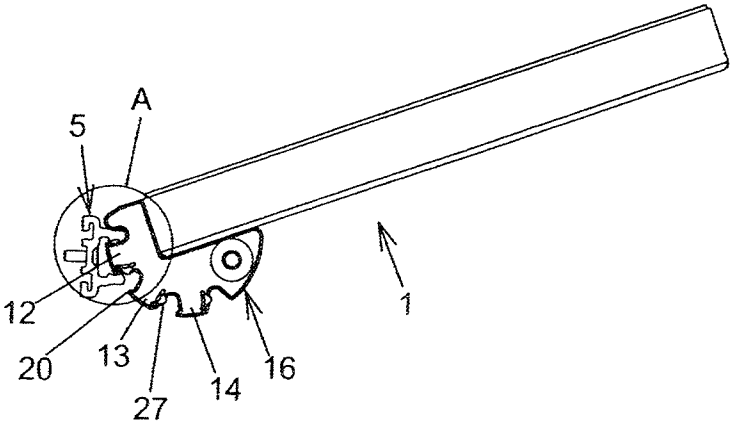
FIG. 14 shows a side view of an intermediate position when connecting the storage tray unit to the carrying unit according to said modified embodiment.
Figure 16:
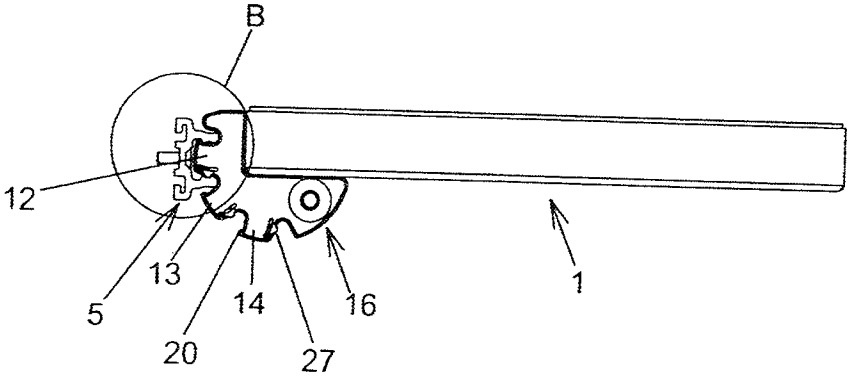
FIG. 16 shows a side view of the connected state.
Figure 18:
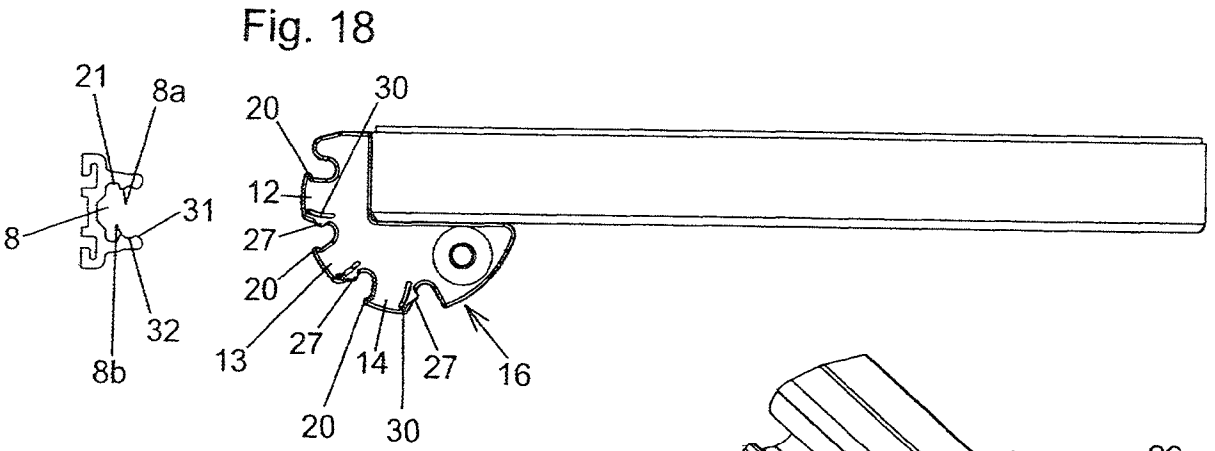
FIG. 18 shows a side view of the separated state.

To connect the storage stray unit 1 to the carrying unit 5, as in the exemplary embodiment described beforehand, the storage tray unit 1 is initially pivoted with respect to the end position, the free side of the storage tray unit 1 lying higher up than in the end position, and the corresponding lug 12, 13, 14 is inserted in this position into the accommodating groove 8, cf. FIGS. 14 and 15. When, as a result, the free side of the storage tray unit 1 is pivoted downward, the projection 20 then moves into engagement with the indentation 21 in the upper boundary wall 8*a* of the accommodating groove 8. In addition, the snap-type projection 27 is guided over the elevation 31 in the lower boundary wall 8*b* of the accommodating groove 8, it being pre-stressed elastically. As a result, the snap-type projection 27 snaps into the snap-in indentation 32 in the lower boundary wall 8*b*, cf. FIGS. 16 and 17. The security of the anchoring in the carrying unit 5 is improved by said additional snap-type connection compared to the exemplary embodiment described beforehand, in particular in the case of forces which act on the storage tray unit 1 from below, by means of which the snap-type connection is still not released.

Snap-type projections 27 could also be realized in another manner, for example by means of a snap-type element which is displaceable against the force of a spring. Snap-type projections could also be realized directly on the profiled rail portions 29.

Figure 21:
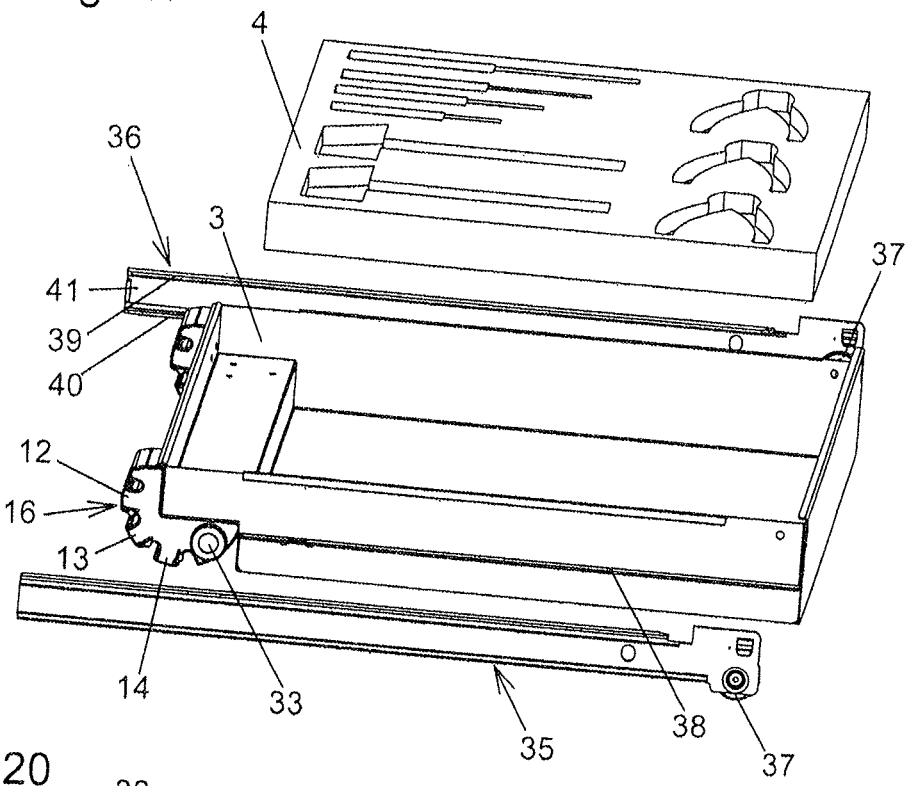
FIG. 21 shows an exploded representation of the guide rails, of the tray body of the storage tray and of the rigid foam liner of the tray body.
Figure 20:
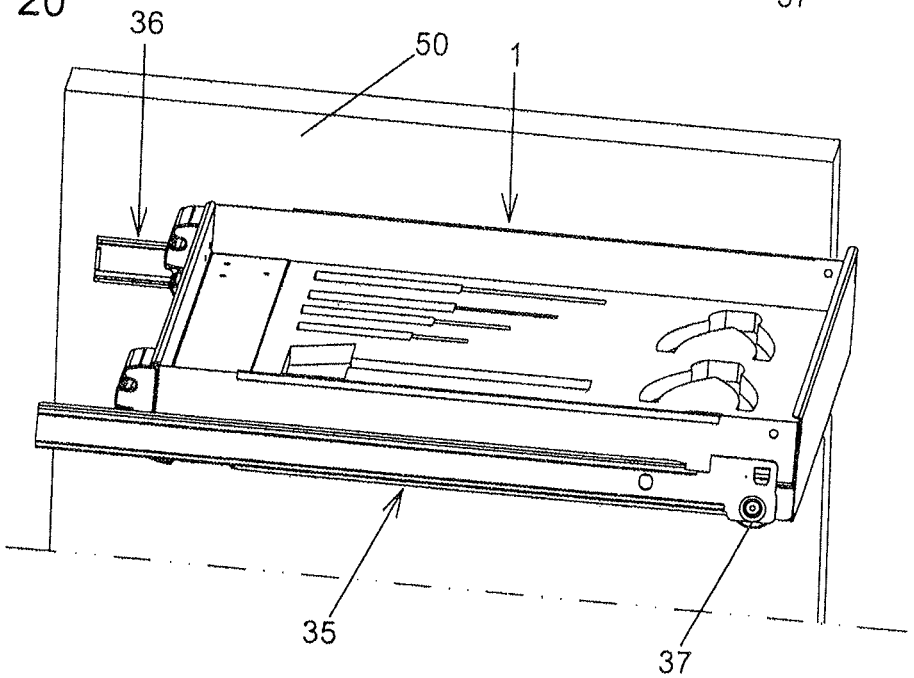
FIG. 20 shows an inclined view of an item of furniture with a pull-out guide means which comprises a storage tray unit according to the invention, only a portion of a side wall of the item of furniture being shown.

FIGS. 20 and 21 show the realization of a pull-out guide means by means of a storage tray unit according to the invention. In the exemplary embodiment of FIGS. 20 and 21, for this purpose on opposite sides of the storage tray unit 1 casters 33 are rotatably mounted on said storage tray unit. The direction in which the casters 33 are spaced apart is, in this connection, at right angles to the insertion direction in which the lugs 12, 13, 14 are inserted into the accommodating groove 8 when connecting to a carrying unit 5.

Apart from said casters 33, the storage tray unit can be realized identically as in the exemplary embodiments described beforehand. For example, the casters 33 can be rotatably mounted on the connecting pieces 16, 17, for example by shafts of the casters 33 being inserted into accommodating openings 34 (cf. FIG. 19) in the end caps 28.

The casters 33 are insertable into first and second guide rails 35, 36. In the state inserted into the guide rails 35, 36, the storage tray unit 1, at least one portion of which lies between the guide rails 35, 36, is displaceable in the longitudinal direction of the guide rails 35, 36.

A caster 37 is rotatably mounted in the region of the front end of the guide rail 35, 36 on the respective guide rail 35, 36. The front end of the guide rail 35, 36 is the one from which the storage tray unit 1 is supplied when connecting to the guide rails 35, 36. The storage tray unit 1 connected to the guide rails 35, 36 rests on the respective caster 37 by way of a respective running web 38.

Apart from regions of its front end portions, the guide rails 35, 36 are realized in a C-shaped manner in cross section with upper and lower running webs 39, 40 which are connected together by means of a base web 41. The respective caster 33 of the storage tray unit 1 can roll between the running webs 39, 40. The upper running web 39 ends at a spacing from the front end of the respective guide rail 35, 36 or comprises a recess in the vicinity of said front end, As a result of said exposed regions, the casters 33 can be introduced behind the casters 37 into the space between the running webs 39, 40 of the guide rails 35, 36 when connecting the storage tray unit 1 to the guide rails 35, 36.

Various measures can be provided to prevent the casters 33 moving out of the exposed portions of the upper running webs 39 in an unwanted manner when the storage tray unit 1 has been pulled out. For example, it could be possible to provide a stop which delimits the pulling out of the storage tray unit 1 at a position before the casters 33 reach the exposed regions of the of the upper running webs 39, and which can be overcome by raising the front end of the storage tray unit 1.

In this way, a pull-out guide means is formed such that the storage tray unit 1 is able to be utilized as a drawer. An item of furniture can be equipped with one or several pairs of guide rails 35, 36 in order to be able to insert one or several storage tray units 1 at the same time as drawers. Only part of one of the side walls of an item of furniture 50 is indicated schematically in FIG. 20. When the storage tray unit 1 is removed from the guide rails 35, 36, the storage tray unit 1 can be utilized as described beforehand in conjunction with FIGS. 1 to 19. The guide rails 35, 36, in this connection, remain connected to the item of furniture 50.

Figure 23:
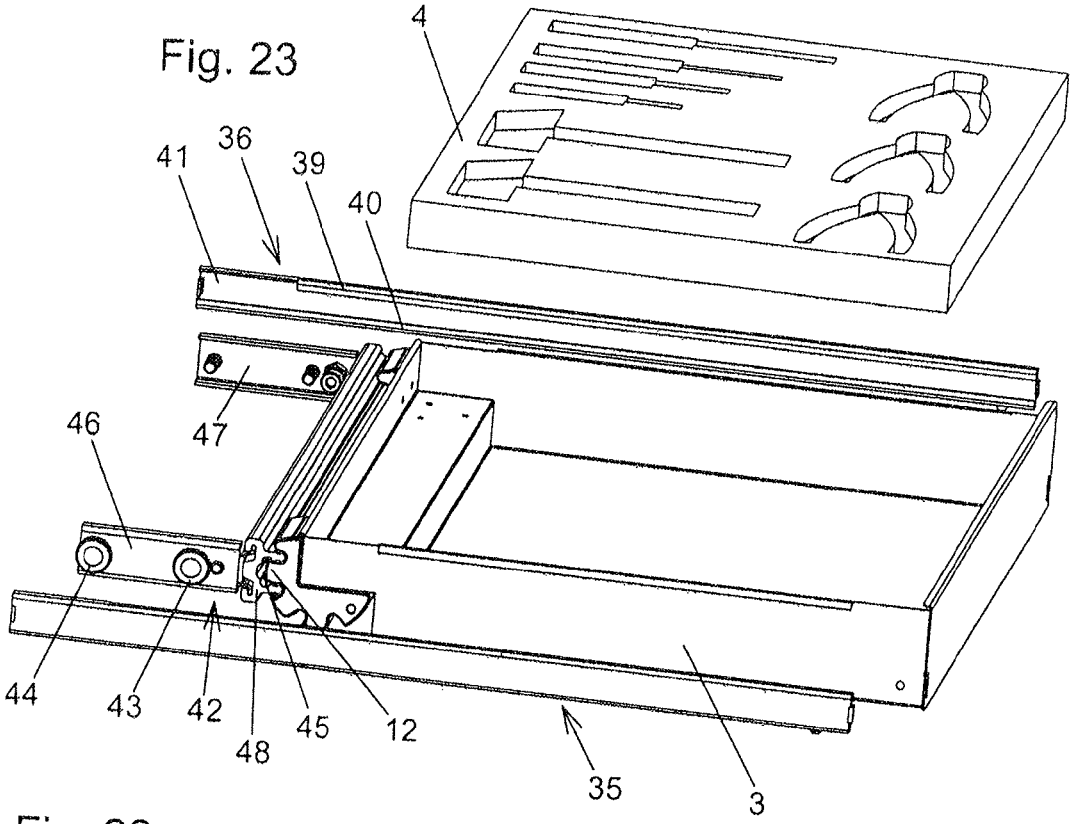
FIGS. 22 and 23 shows representations analogous to FIG. 20 and FIG. 21 for a further exemplary embodiment of an item of furniture having a pull-out guide means.
Figure 22:
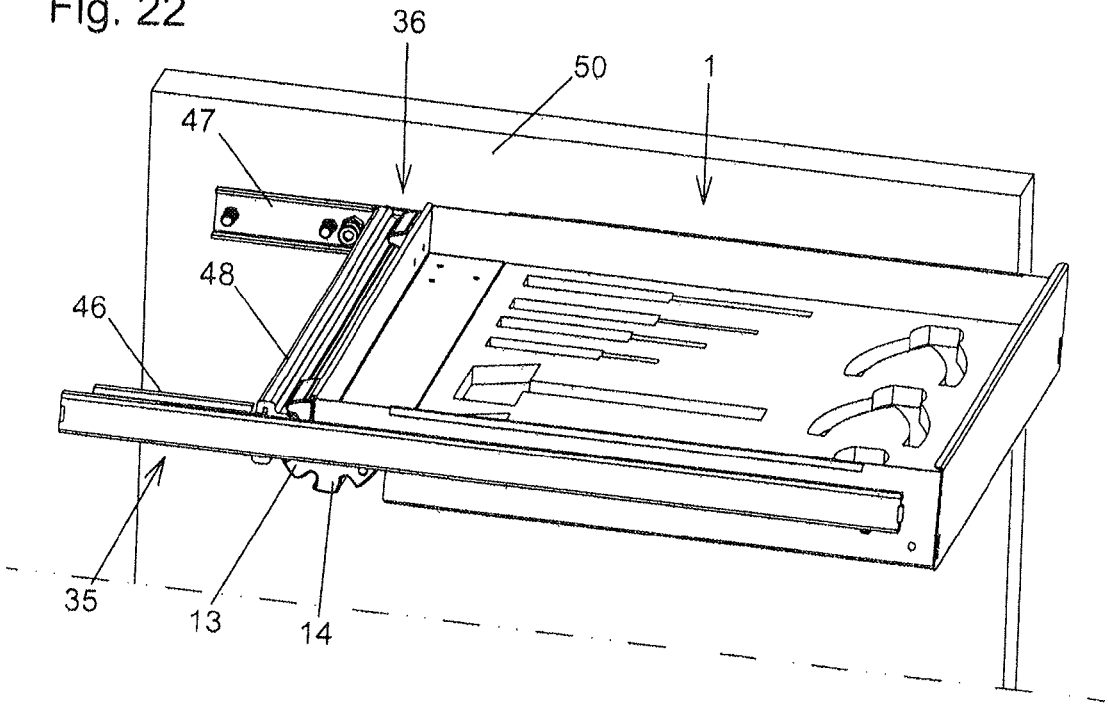

A further possible configuration to provide a pull-out guide means is shown in FIGS. 22 and 23. In the case of said design, there is a guide unit 42 which comprises rotatably mounted casters 43, 44 which are arranged on opposite sides. For example, two casters 43, 44 are rotatably mounted on each side. The guide unit 42 lies between a first and a second guide rail 35, 36, the casters 43, 44 being able to roll between the upper and lower running webs 39, 40 of the guide rails 35, 36. The upper and lower running webs 39, 40 are connected together by a base web 41, as a result of which there is a C-shaped design.

In addition, the guide unit 42 has an accommodating groove 45 which comprises the same cross sectional form (cross sectional contour) as the accommodating groove 8 of the at least one carrying unit 5. In the exemplary embodiment, the casters 43, 44 are rotatably mounted on carrying rails 46, 47 which are connected together by means of a profiled rail 48 which comprises the accommodating groove 45. In this connection, the carrying rails 46, 47 and the profiled rail 48 are at right angles with respect to one another. The profiled rail 48 comprises the same profiled form as the carrying unit 5.

The storage tray unit 1 is consequently connectable to the profiled rail 48 via its lugs 12, 13, 14, preferably by the at least one lug 12, by which a horizontal alignment of the storage tray unit 1 which is connected to the profiled rail 48 is achieved.

Consequently the storage tray unit 1 can be used as a drawer. An item of furniture 50 can comprise one or several pairs of guide rails 35, 36, by which in each case a guide unit 42 is displaceably guided. A storage tray unit 1 can be connected to a respective guide unit 42 such that a corresponding number of drawers can be realized.

When the storage tray unit 1 is removed from the guide unit 42, it can be inserted as described in conjunction with FIGS. 1 to 19. In this connection, the guide unit 42 remains displaceably mounted in the guide rails 35, 36, which remain connected to the item of furniture 50.

In the exemplary embodiments corresponding to FIGS. 20 to 23, the guide rails 35, 36 are connected in an immobile manner to the item of furniture 50. Embodiments where the guide rails 35, 36 are connected to the item of furniture 50 in each case by at least one further rail would also be conceivable and possible. In particular, first and second body rails, with respect to which the first and second guide rails 35, 36 are displaceably guided, could be fastened on the item of furniture 50. Full extensions or excessive extensions can be realized in this manner.

An item of furniture 50 in the form of a tool cabinet can be realized in the described manner.

KEY TO THE REFERENCE NUMERALS

1 Storage tray unit
2 Compartment
3 Tray body
4 Rigid foam liner
5 Carrying unit
6 Opening
7 Screw
8 Accommodating groove
8*a* Upper boundary wall
8*b* Lower boundary wall
9 Upper boundary web
10 Lower boundary web
11 Base web
12 Lug
13 Lug
14 Lug
15 Bottom
16 First connecting piece
17 Second connecting piece
18 Abutment web
19 Abutment web
20 Projection
21 Indentation
22 Insertion direction
23 Rounding
24 Double arrow
25 Groove
26 Rubber strip
27 Snap-type projection
28 End cap
29 Profiled rail portion
30 Opening
31 Elevation
32 Snap-in indentation
33 Caster
34 Accommodating opening
35 Guide rail
36 Guide rail
37 Caster
38 Running web
39 Upper running web
40 Lower running web
41 Base web
42 Guide unit
43 Caster
44 Caster
45 Accommodating groove
46 Carrying rail
47 Carrying rail
48 Profiled rail
50 Item of furniture

The invention claimed is:

1. A device for storing utensils said device comprising a storage tray unit for accommodating utensils to be stored, the storage tray having at least two lugs directed in different directions, and a carrying unit to which the storage tray unit is connectable for carrying the storage tray unit and is removable from the carrying unit, the carrying unit having an accommodating groove extending in a horizontal direction, wherein the storage tray unit is connectable to the carrying unit in at least two different angular positions with reference to a horizontal axis, and different ones of the at least two lugs of the storage tray unit are inserted into the accommodating groove of the carrying unit for connecting the storage tray unit to the carrying unit in different angular positions, wherein the storage tray unit connected to the carrying unit extends out from the carrying unit, wherein, for each angular position, the storage tray unit is connectable with the carrying unit such that only one or more lugs which extend in the same direction are inserted into the accommodating groove and the remaining lugs which are directed in different directions are free from the carrying unit, and wherein a respective one of the lugs comprises a projection which stands out upward in a state inserted into the accommodating groove and, with the storage tray unit connected to the carrying unit, engages in an indentation in an upper boundary wall of the accommodating groove, and the storage tray unit is secured in a positive locking manner against being pulled out of the carrying unit in a rectilinear manner.

2. The device as claimed in claim 1, wherein there are a plurality of the storage tray units and all of the storage tray units are connectable to the carrying unit in at least two different ones of the angular positions with reference to a horizontal axis, and different ones of the lugs of a respective one of the storage tray units are insertable into the accommodating groove of the carrying unit for connecting the storage tray unit to the carrying unit in the different angular positions.

3. The device as claimed in claim 1, wherein on an underside of a respective one of the lugs in a state inserted into the accommodating groove, a respective one of the lugs comprises at least one of a bevel or rounding which tapers in cross section toward an end thereof.

4. The device as claimed in claim 1, wherein the carrying unit is formed by, or includes, a profiled rail which comprises the accommodating groove which is continuous for insertion of the at least one lug of the storage tray unit.

5. The device as claimed in claim 4, wherein the storage tray unit is horizontally displaceable when connected to the carrying unit, and the at least one lug of the storage tray unit inserted into the accommodating groove is displaceable in a longitudinal direction of the accommodating groove.

6. The device as claimed in claim 1, wherein the device includes several of the carrying units which are arranged at different heights and several of the storage tray units which are selectively connectable to the carrying units.

7. The device as claimed in claim 2, wherein a respective one of the storage tray units comprises a tray body, on one side of which are mounted first and second connecting pieces which are spaced apart from one another and in each case comprise at least one of the lugs for insertion into the accommodating groove.

8. The device as claimed in claim 7, wherein the first and second connecting pieces comprise in each case a profiled rail portion or are formed by said profiled rail portion.

9. The device as claimed in claim 1, wherein a rigid foam liner which comprises compartments for accommodating utensils to be stored is inserted into the tray body.

10. The device as claimed in claim 1, wherein at least part of the lugs comprises at least one snap-type projection which stands out downward when inserted into the accommodating groove and, when the lug is inserted into the accommodating groove, is snapped into a snap-in indentation in a lower boundary wall of the accommodating groove.

11. The device as claimed in claim 1, wherein the device includes a guide unit and the guide unit comprises the carrying unit having the accommodating groove into which at least one of the lugs of the storage tray unit is insertable for connecting the storage tray unit to the guide unit, the storage tray unit connected to the guide unit extends out from the guide unit, and the guide unit, for forming the pull-out guide arrangement is mounted so as to be displaceable with respect to first and second guide rails, which are arranged on both sides of the guide unit, in the longitudinal direction of the guide rails.

12. A pull-out guide arrangement which includes a device as claimed in claim 11.

13. An item of furniture having at least one pull-out guide arrangement which includes a device as claimed in claim 11.

14. The device as claimed in claim 1, wherein there are a plurality of the storage tray units that are each connectable to the carrying unit in different angular positions.

15. The device as claimed in claim 1, wherein there are a plurality of the storage tray units and a plurality of the carrying units, and the storage tray units are each connectable to any of the carrying units in different angular positions.

16. A device for storing utensils said device comprising a storage tray unit for accommodating utensils to be stored, the storage tray having at least two lugs directed in different directions, and a carrying unit to which the storage tray unit is connectable for carrying the storage tray unit and is removable from the carrying unit, the carrying unit having an accommodating groove extending in a horizontal direction, wherein the storage tray unit is connectable to the carrying unit in at least two different angular positions with reference to a horizontal axis, and different ones of the at least two lugs of the storage tray unit are inserted into the accommodating groove of the carrying unit for connecting the storage tray unit to the carrying unit in different angular positions, wherein the storage tray unit connected to the carrying unit extends out from the carrying unit, wherein a respective one of the lugs comprises a projection which stands out upward in a state inserted into the accommodating groove and, with the storage tray unit connected to the carrying unit, engages in an indentation in an upper boundary wall of the accommodating groove, and the storage tray unit is secured in a positive locking manner against being pulled out of the carrying unit in a rectilinear manner, and wherein the storage tray unit comprises at least two casters which are rotatably mounted on opposite sides of the storage tray unit, and to form a pull-out guide arrangement the storage tray unit is insertable with the casters into first and second guide rails in which the storage tray unit is mounted displaceable in a longitudinal direction of the guide rails.

17. A pull-out guide arrangement which includes a device as claimed in claim 16.

18. An item of furniture having at least one pull-out guide arrangement which includes a device as claimed in claim 16.

* * * * *